US008305234B2

(12) United States Patent
Tauchi et al.

(10) Patent No.: US 8,305,234 B2
(45) Date of Patent: Nov. 6, 2012

(54) VEHICULAR INFORMATION PROVISION APPARATUS

(75) Inventors: Makiko Tauchi, Kariya (JP); Hirofumi Kiyohara, Anjo (JP); Yuuji Matsumoto, Chiryu (JP); Tetsuya Enokizaka, Nagoya (JP); Hiroshi Tsukahara, Musashimurayama (JP); Osamu Masutani, Yokohama (JP); Mitsuo Yamamoto, Yokohama (JP)

(73) Assignee: DENSO CORPORATION, Kariya (JP)

( * ) Notice: Subject to any disclaimer, the term of this patent is extended or adjusted under 35 U.S.C. 154(b) by 440 days.

(21) Appl. No.: 12/010,339

(22) Filed: Jan. 24, 2008

(65) Prior Publication Data

US 2008/0284615 A1 Nov. 20, 2008

(30) Foreign Application Priority Data

Jan. 30, 2007 (JP) ..... 2007-19396

(51) Int. Cl.
*G08G 1/00* (2006.01)

(52) U.S. Cl. ..... 340/901; 340/988; 340/576

(58) Field of Classification Search ..... 340/576, 340/988, 901, 905; 701/117
See application file for complete search history.

(56) References Cited

U.S. PATENT DOCUMENTS 5,699,056 A * 12/1997 Yoshida ..... 340/905
5,801,763 A * 9/1998 Suzuki ..... 348/77
5,813,989 A * 9/1998 Saitoh et al. ..... 600/484
6,480,783 B1 * 11/2002 Myr ..... 701/117
6,734,799 B2 * 5/2004 Munch ..... 340/576
6,868,332 B2 * 3/2005 Hashimoto ..... 701/200
6,995,663 B2 * 2/2006 Geisler et al. ..... 340/439
6,998,972 B2 * 2/2006 Geisler et al. ..... 340/439
7,027,621 B1 * 4/2006 Prokoski ..... 382/118
7,167,106 B2 * 1/2007 Haase ..... 340/909
7,187,292 B2 * 3/2007 Hayashi et al. ..... 340/576
7,190,274 B2 * 3/2007 Ihara et al. ..... 340/575
7,292,152 B2 * 11/2007 Torkkola et al. ..... 340/576
7,301,464 B2 * 11/2007 Coulter ..... 340/573.7
7,317,386 B2 * 1/2008 Lengning et al. ..... 340/439
7,468,673 B2 * 12/2008 Sultan et al. ..... 340/576
7,526,333 B2 * 4/2009 Yasushi et al. ..... 600/519
2002/0067269 A1 * 6/2002 Cadell et al. ..... 340/573.1
(Continued)

FOREIGN PATENT DOCUMENTS

JP A-10-082653 3/1998
(Continued)

OTHER PUBLICATIONS

Office Action mailed Feb. 8, 2011 issued in corresponding JP patent application No. 2007-019396 (English translation enclosed).

*Primary Examiner* — Jennifer Mehmood
*Assistant Examiner* — Brian Wilson
(74) *Attorney, Agent, or Firm* — Posz Law Group, PLC

(57) ABSTRACT

An information provision apparatus of the present invention includes a stop detector to detect a stop of a vehicle; a display unit to display various information; and a control unit to control the display unit to display a plurality of display contents in a manner that two successive contents of information differ with each other while the vehicle is standing at the temporal stop. When the vehicle is caught in a traffic congestion to stop temporarily, the driver of the vehicle is entertained by plural contents of the information appearing on the display unit for his/her diversion.

20 Claims, 5 Drawing Sheets

U.S. PATENT DOCUMENTS

| | | | | |
|---|---|---|---|---|
| 2003/0146841 | A1* | 8/2003 | Koenig | 340/576 |
| 2004/0098193 | A1* | 5/2004 | Kageyama | 701/207 |
| 2004/0201583 | A1* | 10/2004 | Burroughes et al. | 345/211 |
| 2005/0093719 | A1* | 5/2005 | Okamoto et al. | 340/995.1 |
| 2005/0128063 | A1* | 6/2005 | Isaji et al. | 340/439 |
| 2006/0006990 | A1* | 1/2006 | Obradovich | 340/439 |
| 2006/0164230 | A1* | 7/2006 | DeWind et al. | 340/461 |
| 2006/0220915 | A1* | 10/2006 | Bauer | 340/945 |
| 2007/0005231 | A1* | 1/2007 | Seguchi | 701/117 |
| 2007/0159344 | A1* | 7/2007 | Kisacanin | 340/576 |
| 2007/0290867 | A1* | 12/2007 | Kuramori et al. | 340/576 |
| 2007/0296601 | A1* | 12/2007 | Sultan et al. | 340/576 |
| 2008/0030313 | A1* | 2/2008 | Obradovich | 340/439 |
| 2008/0105482 | A1* | 5/2008 | Yamaguchi et al. | 180/271 |
| 2009/0160676 | A1* | 6/2009 | Stehle et al. | 340/905 |
| 2009/0224942 | A1* | 9/2009 | Goudy et al. | 340/905 |
| 2009/0299857 | A1* | 12/2009 | Brubaker | 705/14.66 |

FOREIGN PATENT DOCUMENTS

| | | |
|---|---|---|
| JP | A-2002-107156 | 4/2002 |
| JP | A-2002-243472 | 8/2002 |
| JP | 2004-355055 | * 12/2004 |
| JP | A-2004-355055 | 12/2004 |
| JP | A-2005-121382 | 5/2005 |
| JP | A-2005-222241 | 8/2005 |
| JP | A-2005-352619 | 12/2005 |
| JP | A-2006-284314 | 10/2006 |

* cited by examiner

FIG. 6A
INFO. DB
| | |
|---|---|
| SHORT | a b c d e f |
| LONG | A B C D E |
| LAST | Z Y X |
FIG. 6B
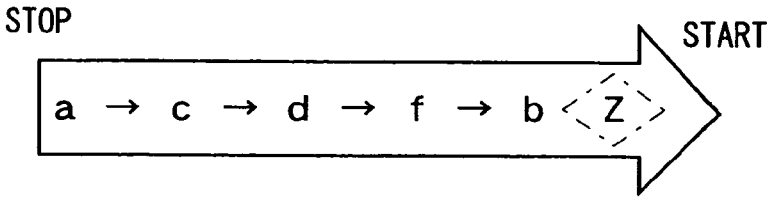
FIG. 6C
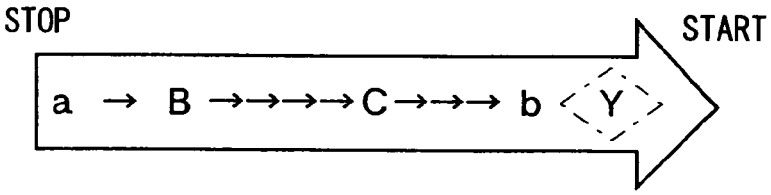
FIG. 7
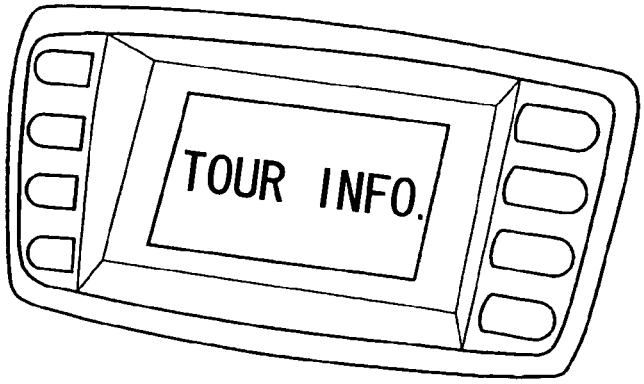

VEHICULAR INFORMATION PROVISION APPARATUS

CROSS REFERENCE TO RELATED APPLICATION

This application is based on and claims the benefit of priority of Japanese Patent Application No. 2007-19396 filed on Jan. 30, 2007, the disclosure of which is incorporated herein by reference.

FIELD OF THE DISCLOSURE

The present disclosure generally relates to an information provision apparatus for use in a vehicle.

BACKGROUND INFORMATION

In recent years, a technique for preventing uneasiness of a driver in a traffic congestion due to slower and/or stopped traffic in spite of a traffic light being turned to green is provided, for example, in Japanese patent document JP-A-2005-222241. That is, the disclosure in the above patent application illustrates a configuration that prevents the uneasiness of the driver who does not know why traffic is slower or stopped.

In the above disclosure, a head vehicle in the traffic congestion captures an image of the front area and transmits the image to the rear vehicles in the traffic congestion, thereby enabling the rear vehicles to view the situation of the congestion. In this manner, the situation of the congestion such as a gridlocked intersection condition can be viewed in the rear vehicles for preventing the uneasiness of the drivers in the rear vehicles.

In this case, the situation presented as an image eases the drivers in the rear vehicles to wait until the congestion cause is resolved by remembering similar situations. However, when the image of the intersection does not explain the cause of the congestion, the uneasiness of the driver will not be resolved. Further, the repeated provision of the intersection image may bore the driver, thereby leading to a non-satisfaction of the driver.

SUMMARY OF THE DISCLOSURE

In view of the above and other problems, the present invention provides an apparatus that prevents the driver to feel the uneasiness due to a temporal stop of the vehicle in a traffic congestion or the like by feeding the driver with information.

The apparatus of the present includes a stop detection unit capable of detecting a temporal stop of a vehicle, a display unit capable of displaying various information to be viewed by an occupant of the vehicle, and a control unit capable of serially feeding the display unit with different information in an ever-changing manner while the vehicle is temporarily stopping. The apparatus of the present invention thus provides information in different categories for the driver of the vehicle when the vehicle stops due to a traffic congestion, thereby having a good time of diversion and being eased from the uncomfortableness. Further, the information fed in an ever-changing manner, that is, information fed in a manner that avoids successive provision of information in the same category, allow the driver to pay too much attention for the information on the display unit, thereby enabling the driver to resume the driving operation without lingering distraction left on the provided information.

BRIEF DESCRIPTION OF THE DRAWINGS

Other objects, features and advantages of the present invention will become more apparent from the following detailed description made with reference to the accompanying drawings, in which:

FIGS. 6A to 6C show illustrations of information database and information provision sequence including long time information and short time information;

FIG. 7 shows an illustration of information provided on a display screen;

DETAILED DESCRIPTION

Figure 1:
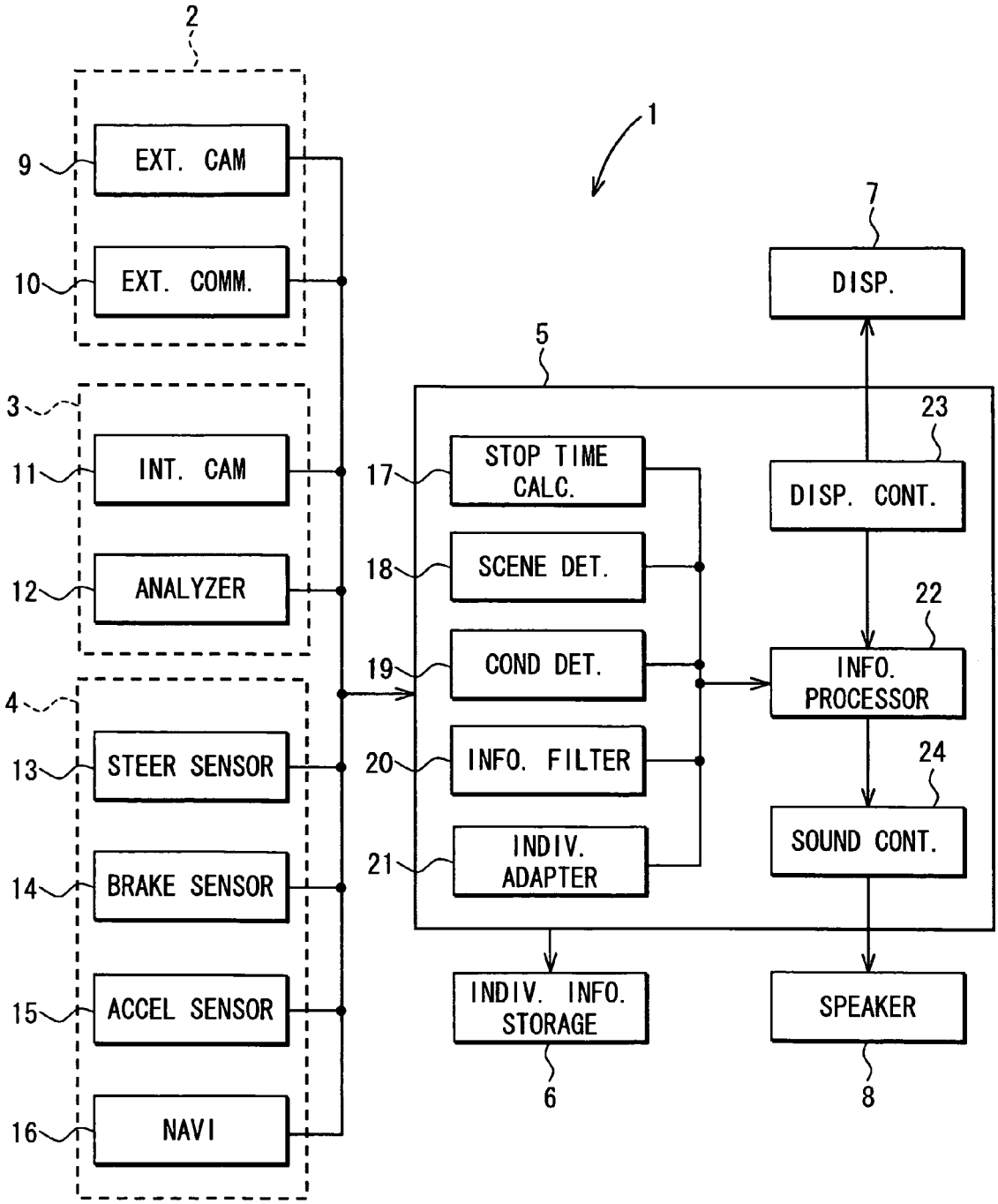
FIG. 1 shows a block diagram of an information provision apparatus in an embodiment of the present invention.

One embodiment of the present invention is explained as follows while referring to the drawing. First, FIG. 1 is a total configuration of an information provision apparatus 1 for use in a vehicle in the present embodiment. The information provision apparatus 1 is intended to be carried by the vehicles such as automobiles as shown in FIG. 1, and three sensing systems, that is, an external information sensing system 2, an inside information sensing system 3, vehicle information sensing system 4. In addition, the information provision apparatus 1 consists mainly of an arithmetic unit (i.e., a control unit in conceptual language) 5, and the arithmetic unit 5 is connected to three sensing systems 2, 3, 4 as well as a personal information accumulation device 6, a display unit 7 and a voice-output device 8.

The external information sensing system 2 consists of an external camera 9 and an in-vehicle outside communications equipment 10. The external camera 9 is installed at an inside or outside of the vehicle compartment of the subject vehicle for imaging a front image of the subject vehicle. The in-vehicle outside communications equipment 10 is an equipment for road-vehicle-communication and/or vehicle to vehicle communications, and acquires, from road-side infrastructure, traffic light information that includes signal states (that is, a red light (stop signal), a green light (proceed signal), a yellow light (caution signal)) of a road-side device installed in the forward crossings of the subject vehicle, time of each signal state, a position of the road-side device (longitude and latitude) and the like.

In addition, the in-vehicle outside communications equipment 10 acquires traffic congestion information from a traffic information center. The traffic congestion information includes a position (a longitude and a latitude) of the congestion section of the traffic congestion occurring ahead of the subject vehicle, a length of the traffic congestion section, a passage expectation time of the traffic congestion section and the like. Furthermore, the in-vehicle outside communications equipment 10 transmits and receives various information between the information center outside of the subject vehicle, and various information can also be transmitted and received between surrounding vehicles around the subject vehicle.

The inside information sensing system 3 mainly consists of an internal camera 11 and an eye/speech analysis device (i.e., a driver condition detector in conceptual language) 12. The internal camera 11 is installed in an appointed position in the compartment of the subject vehicle for imaging drive's face image in the subject vehicle. The eye/speech analysis device 12 estimates the eyes direction (by using XYZ coordinate having the sitting position of the vehicle driver defined as the origin with the X-axis aligned with vehicle's front-rear direction, the Y-axis in the lateral direction and the Z-axis in the vertical direction) of the vehicle driver, the driving state of the vehicle driver, an atmosphere in the compartment of the subject vehicle based on the analysis (a sound recognition result) of the sound of the vehicle driver and passengers from a voice-input device (not illustrated) as well as the driver's face image input from the camera 11.

The driving state of the driver is represented as an awakening degree, feelings of the vehicle driver, a degree of carelessness and the like, in this case. The awakening degree of the vehicle driver is measured and estimated based on the number of blinks and the speed of the blinks of the vehicle driver derived from the face image of the vehicle driver. The feelings of the driver is estimated from the face image (the degree of opening of lips and eyes) of the vehicle driver, the volume of the voice, the words (e.g., vocabulary) as well as the tone (i.e., highness/lowness of frequency) of the driver's voice. In addition, the carelessness of the vehicle driver is estimated from the degree of change of the eyes direction of the vehicle driver.

In addition, because the atmosphere in the compartment is affected by the number of people in the vehicle, the number of people in the subject vehicle is considered. For example, when the driver is an only occupant of the subject vehicle, the atmosphere (e.g., quietness, strain, liveliness and the like) in the compartment of the vehicle is estimated from the driving state of the vehicle driver. On the other hand, when the driver is accompanied by other occupants in the subject vehicle, the atmosphere (quietness, strain, liveliness) in the vehicle is estimated from a conversation or lack of conversation, the laughing/angry voice or the like in the conversation, the words (e.g., vocabulary) of the occupants.

The vehicle information sensing system 4 consists of a steering angle sensor 13, a brake pedal manipulation variable detection sensor (i.e., brakes sensor in the following) 14, an accelerator pedal manipulation variable detection sensor (an accelerator sensor in the following) 15 and a navigation system 16. The steering angle sensor 13 is a sensor detecting the steering angle (i.e., the angle of steer of the subject vehicle from a neutral position of the steering wheel that is defined as the steering position when the vehicle is traveling straight) of the steering wheel of the subject vehicle. The brakes sensor 14 is the sensor detecting a quantity of pressing of the brake pedal by the vehicle driver, and the accelerator sensor 15 is a sensor detecting a quantity of pressing of the accelerator pedal by the vehicle driver. The detecting signal output from these sensors 13, 14, 15 is provided for the arithmetic unit 5.

The navigation system 16 consists of a well known type of a vehicle position detector, an operation switch group, a map data storage unit, a display unit and the like (not illustrated), and outputs, under control of an instruction from the arithmetic unit 5, various information processed therein and information stored in the map data storage unit to the arithmetic unit 5.

The personal information accumulation device 6 accumulates personal information such as general information (a full name, age, an occupation, sex, married/single distinction, having children and the like) as well as information about a personal hobby/idea. More practically, the information of the personal hobby/idea is classified as categories such as music, sports, movies, news, television programs, shopping, restaurants, leisure activities, theme parks, and the like, and lists the contents that suits the preferred hobby/idea of the driver in each of the categories (for example, in a "music" category, a genre (classic, jazz, popular songs or the like), a title, a name of the artist and the like). The personal information accumulation device 6 outputs the personal information having the general information and the information about the hobby/idea in response to an instruction from the arithmetic unit 5. In addition, the personal information in the personal information accumulation device 6 is updated by the arithmetic unit 5 appropriately in a timely manner, and is accumulated in an appending manner.

Furthermore, in the personal information accumulation device 6, a database which accumulates the driving operation (e.g., an operation of a steering wheel, a brake, an accelerator and the like) of the vehicle driver detected by the vehicle information sensing system 4 is installed. The update, addition and the like of the data of the database is performed by the arithmetic unit 5 appropriately.

The display unit 7 is, for example, formed by a liquid crystal display, and is disposed at a position that is viewable by the vehicle driver and other occupants of the vehicle. The voice-output device 8 includes an amplifier (not illustrated), a speaker installed appropriately in the vehicle compartment.

The arithmetic unit 5 includes functional blocks of a halt calculation department (i.e., a stop detector in conceptual language) 17, a scene presumption department 18, a state estimation department (i.e., a driver's condition detector, a condition determiner in conceptual language) 19, an information filtering department 20, an individual adaptation department 21, an information processing department 22, a display control department 23 and a sound control department 24.

Figure 2:
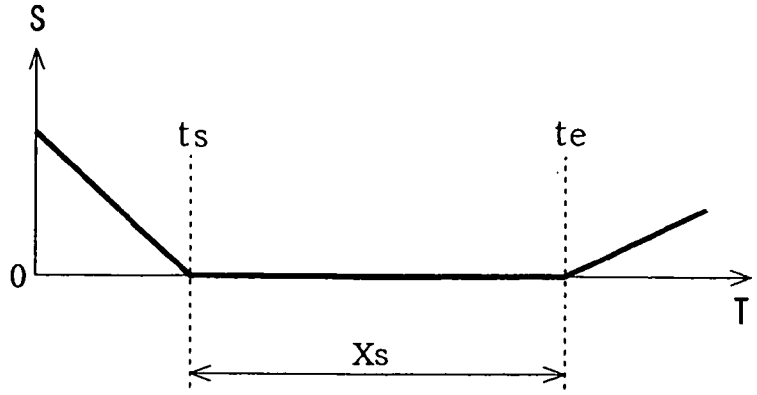
FIG. 2 shows a diagram of vehicle stop time illustrated in association with vehicle speed.

The halt calculation department 17 calculates a stop time (i.e., a halt in the following) when the subject vehicle stops by the stop factors such as the stop signal (a red light) of an existing road-side device (a traffic signal) ahead of the subject vehicle, the stops of the front vehicle due to the traffic congestion by the concentration of traffic and the like. When the subject vehicle stops by the above-described stop factor as shown in FIG. 2, the halt calculation department 17 calculates a halt Xs as the time from a stop start time ts of the subject vehicle to a stop end time te at which a start of the subject vehicle is enabled due to a resolution of the stop factor of the current stop.

The halt Xs is calculated by respectively different calculation methods when the subject vehicle stops due to the stop signal of the road-side device, and when the subject vehicle stops due to the stop of the front vehicle in the traffic congestion ahead of the subject vehicle. The calculation methods of the halt Xs is explained in the following.

Figure 3:
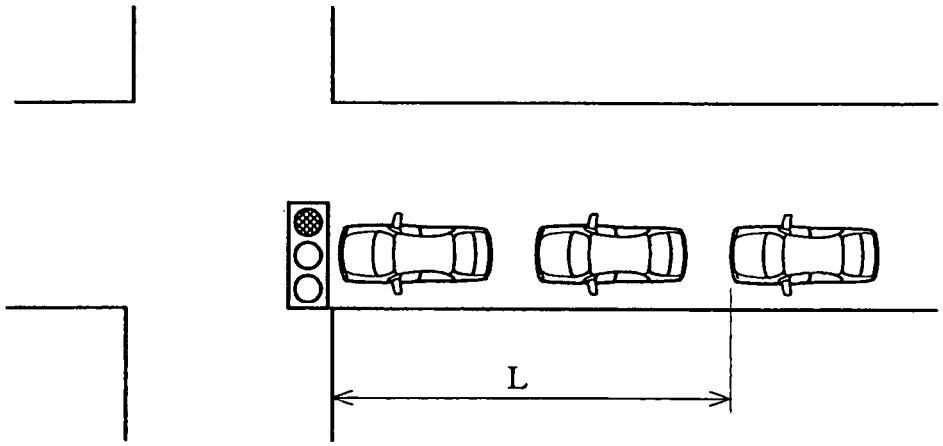
FIG. 3 shows an illustration of a vehicle stop due to a red light of a traffic signal.

FIG. 3 shows a situation in which the subject vehicle stops at the stop signal of the road-side device. In this situation, the traffic light information of the road-side device is acquired through the in-vehicle outside communications equipment 10, and, by referring to the length of time of the stop signal included in the acquired traffic light information, a true stop signal time between the stop start time of the subject vehicle and the time when the stop signal is removed is calculated. The true stop signal time is included in the halt Xs.

When the subject vehicle is at the top of the traffic that is stopped at the stop signal of the road-side device, the true stop signal time is identical to the halt Xs. However, as shown in FIG. 3, if the subject vehicle stops at the tail of the traffic, that is, if there are other stopping vehicles between the traffic light and the subject vehicle when the traffic is stopped at the stop signal, the subject vehicle is not put in a start-able state at a lift of the stop signal as long as the stopping front vehicles do not start from the stopping position.

Therefore, for handling this kind of situation, a required departure time per vehicle is set in advance, and the required departure time is included in the halt Xs together with the true stop signal time in the calculation. In addition, when there are plural vehicles between the road-side device and the subject vehicle as shown in FIG. 3, the number of vehicles in front of the subject vehicle is estimated based on the distance L to the road-side device (or to the stop line at the foot of the road-side device), and a total departure time derived from the required departure time multiplied by the estimated number of the vehicles is included in the halt Xs together with the true stop signal time.

The distance L between the stop signal of the road-side device and the subject vehicle can be calculated, in this case, from a current position (latitude/longitude) of the subject acquired from the navigation system 16 and the position (latitude/longitude) of the road-side device included in the traffic light information acquired through the in-vehicle outside communications equipment 10. The position of the road-side device may also be grasped by referring to the map data of the navigation system 16, and the distance L may be acquired from the position of the road-side device and a current position of the subject vehicle. Further, by using communication between vehicles, the number of vehicles in front of the subject vehicle toward the road-side device may by directly acquired from the other vehicles through the in-vehicle outside communications equipment 10.

Figure 4:
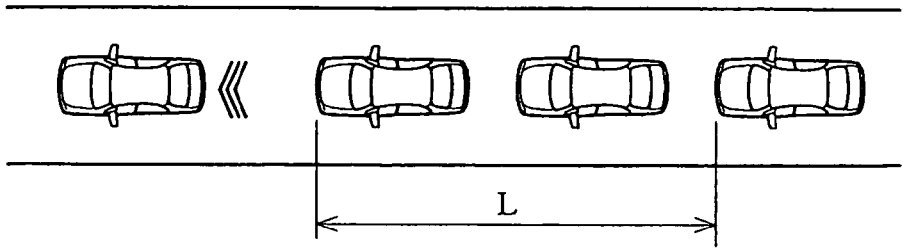
FIG. 4 shows an illustration of a vehicle stop due to a traffic congestion.
Figure 5:
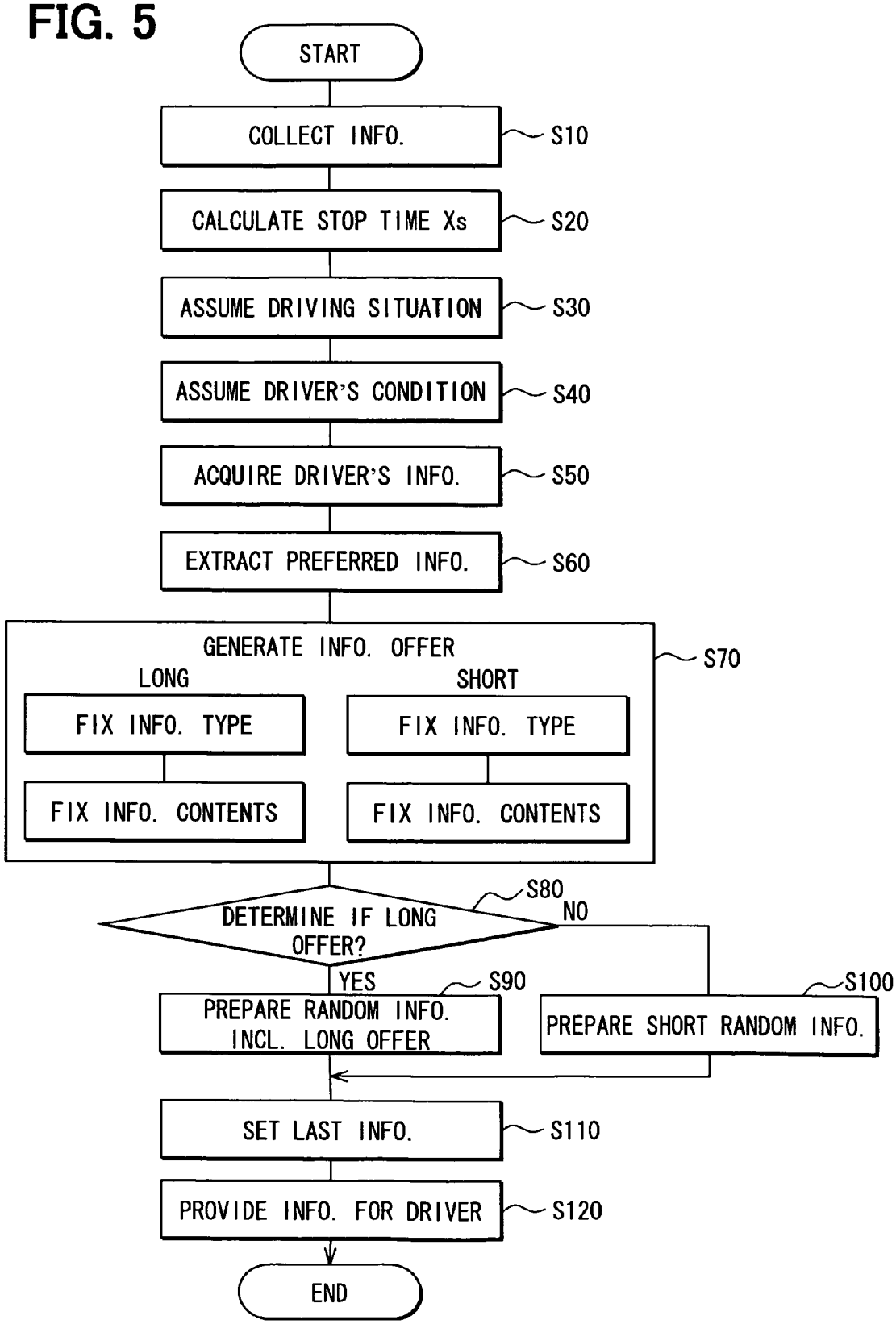
FIG. 5 shows a flowchart of an information provision process by the information provision apparatus.

FIG. 4 shows a situation of the traffic congestion where the subject vehicle is stopping due to the stop of the other vehicles in front of the subject vehicle. First, the traffic congestion information from traffic information center is referred to in such a situation for determining whether the subject vehicle is located in the traffic congestion section. Then, if the subject vehicle is located at the traffic congestion section as a result of the above determination, the total departure time required for the front vehicles (i.e., stopping vehicles) stopping in a series is calculated to be used as the halt Xs (i.e., included in the halt Xs). The number of the stopping vehicles is estimated from a distance L between a top stopping vehicle and the subject vehicle. Thus, the total departure time is calculated by multiplying the required departure time per vehicle by the estimated number of the stopping vehicles.

In addition, the distance L between the top stopping vehicle and the subject vehicle may be acquired from outside of the subject vehicle through the in-vehicle outside communications equipment 10. Further, by using communication between vehicles, the number of vehicles in front of the subject vehicle toward the road-side device may by directly acquired from the other vehicles through the in-vehicle outside communications equipment 10.

In addition, the scene presumption department 18 estimates, from the driving state of the vehicle driver estimated by the eye/speech analysis device 12 as well as an estimation result of the atmosphere in the compartment of the subject vehicle, the condition/circumstance of the driver of the subject vehicle. That is, for example, when there is no co-occupant in the vehicle, the scene presumption department 18 estimates the condition of the driver who is driving alone as a concentrated driving condition, a careless driving condition, a tense driving condition or the like, based on the number of the occupants in the subject vehicle and the atmosphere in the compartment (quietness, strain, liveliness or the like). Further, when there is a co-occupant in the vehicle, the driver's condition is estimated as a co-occupant affected driving condition such as being involved in a conversation or in listening a music with the co-occupant, having the co-occupant in a sleeping condition or the like.

The state estimation department 19 is equipped with a first function that determines whether the driving operation (a steering operation, a brake operation, an accelerator operation or the like) of the vehicle driver detected by the vehicle information sensing system 4 is different (i.e., diverted) substantially from the driving operation of the vehicle driver accumulated in the database in the personal information accumulation device 6 (i.e., from the normal driving operation) for a purpose of determining (estimating) whether the driver's current emotion (i.e., condition) is different from a usual condition (i.e., the normal condition). The determination by the first function is employed as one of predetermined criteria for control determination.

Furthermore, the state estimation department 19 is equipped with a second function that reads feelings (a state) of the vehicle driver from biological information such as the voice, expression, head movement, eye direction, and the like of the vehicle driver acquired by the eye/speech analysis device 12, for a purpose of determining (i.e., estimating) whether the current driver's current condition is different from the normal condition. The second function is also employed as one of predetermined criteria for control determination.

The information filtering department 20 acquires information (offer-able information) that can be offered in subject vehicle from the outside information center through the in-vehicle outside communications equipment 10, and the acquired information is memorized in an information server (not illustrated). The information filtering department 20 filters and extracts, from the offer-able information memorized in the server, the information that is in accordance with the personal information (the general information as well as the information about a hobby/idea as stated above) being input from the individual adaptation department 21, that is, preferred information of the driver. The offer-able information memorized in the information server is accompanied by identification information for use in the information extraction, and the filtering department 20 extracts the offer-able information by checking agreement of the identification information and the personal information.

Then, the information processing department 22 is used to elect (acquire) the information that is suitable for the condition of the driver of the subject vehicle estimated by the scene estimation department 18 from the extracted offer-able information extracted by the information filtering department 20 (i.e., the preferred information of the vehicle driver). Further, the elected information is provided for the driver who is brought to a temporal stop at the stop signal, in traffic congestion or the like, thereby easing the driver in a course of guiding the driver's attention to the information that it is offered in association with the stop factor that has been causing the uncomfortable feeling of the driver.

The information processing department 22 processes, by employing a technique of natural language processing and the like, the elected information described above to have a playback time that is substantially same as the halt Xs calculated by the halt calculation department 17. That is, in other words, the content of the offer-able information is processed (i.e., edited) so that the information provision shall conclude within the halt Xs after a start of the information provision at the time of the stop of the subject vehicle, or at the determination of the stop of the subject vehicle. Details of the editing process of the information by the information processing department 22 is described later.

Then, by providing the contents of the edited information for the driver of the subject vehicle, the driver is enabled to look through the contents of the provided information before starting the subject vehicle. Therefore, the driver's attention is not left to a lingering condition that is partially attracted to the provided information after the start of the vehicle. As a result, the driver's attention is easily focused on the driving operation, that is, concentration on the driving operation is enabled. The information provision apparatus 1 of the present embodiment achieves safety of the driving operation after the start of the vehicle in the above-described manner.

In addition, appearance and arrangement of the information content are adjusted for the viewer (i.e., for an individual driver) by the display control department 23 after the editing of the information by the information processing department 22. Similarly, the sound control department 24 changes the edited information mentioned above for the ease of hearing by the individual driver before outputting as a sound.

Processing control of the offer-able information is explained with reference to FIGS. 5 to 11 in the following. First, in step S10 of FIG. 5, information from the external information sensing system 2, inside information sensing system 3 and vehicle information sensing system 4 is collected, and the halt Xs of the subject vehicle is calculated by the halt calculation department 17 in step S20.

In step S30, the condition of the vehicle driver is estimated by the scene presumption department 18, and then, in step S40, the condition (feelings) of the vehicle driver is estimated by the state estimation department 19. In step S50, the personal information of the vehicle driver is acquired by the personal adaptation department 21, and then, in step S60, the offer-able information that agrees with the hobby/idea of the vehicle driver is extracted by the information filtering department 20. Then, in step S70, the offer-able information extracted in step S60 is further elected and edited by the information processing department 22 for provision to the driver and the co-occupants. In this case, the information content is determined by classifying the content to be provided into categories of long time information and short time information in the first place. More practically, as the long time information, information type (e.g., a television program, a music piece, a DVD track and the like) is determined together with the information content to be provided, and plural information contents are prepared. Similarly, as the short time information, the information type (e.g., a commercial film, four-frame cartoon, a game and the like) is determined together with the information content to be provided, and plural information contents are prepared.

The prepared long time Information A-F and short time information a~f together with last information contents Z, Y, X to be provided are shown in FIG. 6A. These information are memorized in an information database provided in the arithmetic unit 5. Each of the information contents is mentioned later.

Then, in step S80, whether the situation allows the provision of the long time information is determined by the information processing department 22 based on the driver's condition as well as the feelings of the driver, the driving operation and the like. When it is determined that the situation allows the provision of the long time information (YES in step S80), the process proceeds to step S90. In step S90, plural pieces of random information including the long time information such as (a, B, C, b) as exemplarily shown in FIG. 6C is prepared by the information processing department 22.

On the other hand, when it is determined that the situation does not allow the provision of the long time information ("NO" in step S80), the process proceeds to step S100. In step S100, plural pieces of random information including short time information only such as (a, c, d, f, b) as exemplarily shown in FIG. 6B is prepared by the information processing department 22. In addition, the plural pieces of random information contents described above (the contents of processing such as a method of electing the information and the like) is mentioned later in detail.

Then, in step S110, the last information contents to be provided such as Z in FIGS. 6B and Y in FIG. 6C is determined. In addition, about the last information contents to be provided is mentioned later in detail. Then, in step S120, the prepared information is provided for the driver from the display control department 23 and sound control department 24.

The information content is explained in the following. First, information registered by the driver while the vehicle is traveling is, for example, prepared and provided. In addition, information calculated from the presence of the occupants, the number of occupants, day of the week and time of the day (by, for example, using Bayesian theorem) such as a music piece being listened to, a TV/DVD program being watched, a shop visited previously, a tourist spot and the like are prepared and provided. Further, for example, Internet registration information such as gourmet information, travel information, book information and comic information is prepared and provided.

Furthermore, the information of the other person downloaded from the Internet for provision such as the stand-up comedy of younger performers and the like is prepared and provided. Furthermore, the information of the other person who has watched the same music clip and/or the same television program is prepared and provided. In addition, local information such as shop information, tourist spot information, local artist information, local radio information and the like is prepared and provided.

The short time information is the information that can be displayed in one screen of the display unit 7 (e.g., information to be concluded with one screen, or information whose contents can be understood with one screen), and the information that can be provided in a short time and whose contents can be understood in a short time. The short time information is the information mainly formed as a still image, or the information of moving picture if it is played in a short time.

Figure 10:
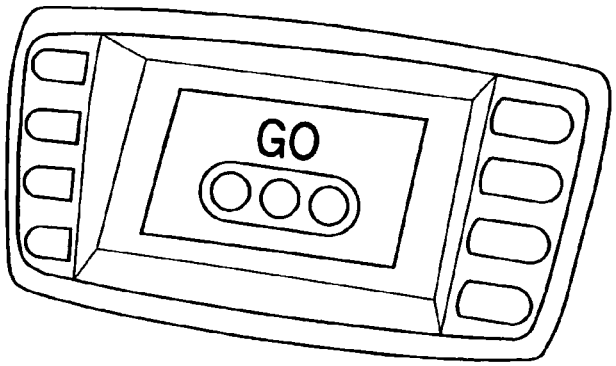
FIG. 10 shows an illustration of information provided at last in the information provision sequence on the display screen.
Figure 11:
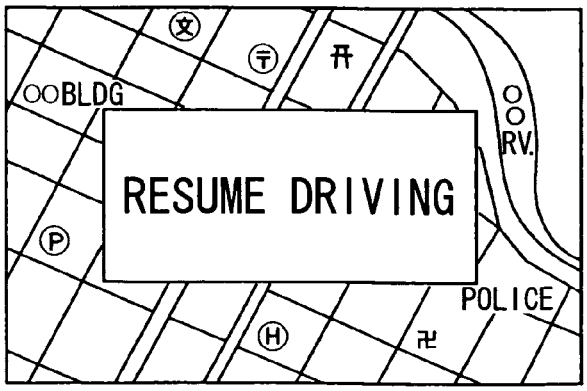
FIG. 11 shows another illustration of information provided at last in the information provision sequence on the display screen.

The long time information is the information of moving picture, a slide show, and a scrollable information, that is, the information that takes longer time to be provided. The last information is the information that turns driver's attention to the driving operation of the vehicle. The last information is, for example, the message and/or the image that notifies the driver that the vehicle has to be started in a short time as shown in FIGS. 10 and 11, or the information completely different from what has been provided to turn the driver's attention to the start of the vehicle, or the information that is meaningless for the driver (e.g., a simple geometrical figure or the like).

When plural information contents are provided in a manner shown in FIGS. 6B, 6C, the information contents is controlled so that the same kind of information is not played in succession in the present invention. In this manner, the driver's attention is diverted from the provided information for a purpose that the driver recovers to his/her senses, thereby turning the driver's attention to the driving operation of the vehicle.

In addition, the information on the display unit 7 is dimmed as time elapses when plural information contents are displayed (refer to FIGS. 6B, 6C) so that the time to start the vehicle is recognized in the present embodiment. In this case, when the display intensity of the information is dimmed, it is preferably performed in a manner that the brightness of the display unit 7 is made thinner, in a manner that the colored displayed is turned to monochrome, or in a manner that the display content is put in occlusion condition.

Furthermore, in the present embodiment, the plural information contents are joined in a fade-out fade-in manner (refer to FIGS. 6B, 6C). The last information to be displayed on the display unit 7 is abruptly displayed without fading in to impresses the vehicle driver that the vehicle is starting in a short time.

In the above-described manner, the traffic congestion is detected based on the vehicle speed, the distance from the front vehicle or the like, the plural information contents such as a four-frame cartoon, news and the like are provided smoothly one by one in a fade-in fade-out manner at the temporal stop due to the traffic congestion so that the driver is eased away from unsafe driving. Then, at the end of the information provision, for a purpose of notifying the driver that the vehicle has to be started in a short time, a screen is turned suddenly to a local commercial film of the driver's preference, news of the day or the like, that is, the content is turned to completely different one from what has been provided to remind the driver of the start of the vehicle in a short time, to encourage the driver to prepare for the start of the vehicle.

The provision of the information that includes the long time information is explained with reference to FIGS. 7 to 11 in the following. In this case, the driver is a female in her 40s, likes trips as well as shopping. She is assumed to be caught in a situation of stopping at a red light of an intersection.

First, as a sightseeing loving driver, tourist information of a popular destination Beijing is acquired from a travel agency through the Internet, and the Beijing tourist information is displayed on the display unit 7 as shown in FIG. 7 (though a text string is shown in FIG. 7, still pictures and/or movies of Beijing tourist information may actually be displayed).

Figure 8:
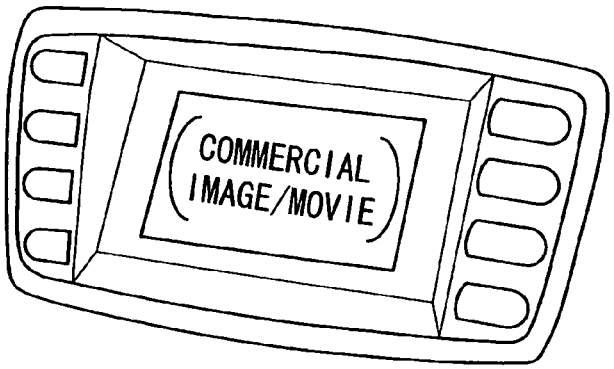
FIG. 8 shows another illustration of information provided on the display screen.

Then, the commercial film of nearby brand-name store is displayed on the display unit 7 based on the map information as shown in FIG. 8, because the vehicle driver likes shopping (though, in FIG. 8, a text string is shown, still images and/or movies from the commercial film of the brand-name store may actually be displayed). In this case, the location of the brand-name store is configured to be displayed.

Figure 9:
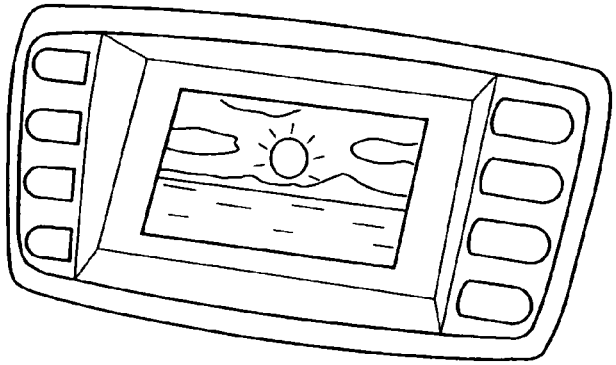
FIG. 9 shows yet another illustration of information provided on the display screen.

Then, on the display unit 7, the pictures taken in the previous tour stored in the hard disk drive (HDD) is displayed in order as a slide show as shown in FIG. 9. Then, at last, information to encourage the driver to start the vehicle is displayed on the display unit 7, that is, information that indicates that the signal has turned to blue is displayed as shown in FIG. 10.

In addition, the last information displayed on the display unit 7 may be the message of "RESUME DRIVING" as shown in FIG. 11. Further, as the last information, the information may be the one that does not have a meaning, or the information may be the scenery of the current district, the scenery of other district. The information may also be the image information of the map from the navigation system 16. The last information is preferably the one that can be recognized at a glance without lingering on the driver's mind. That is, in other words, the information is intended to be recognized as the notice of the start of the vehicle in a short time.

Furthermore, the last information may be a movie that repeats the same scene or the like. Furthermore, the last information may be an output of a voice message such as "The signal changes in a short time." "Start the vehicle right away." or the like.

Furthermore, in the above embodiment, the road-side device is assumed to be the traffic signal, the road-side device may be, for example, a radio beacon, a light beacon or the like that is communicable. In addition, the communication method such as a dedicated short range communication (DSRC), a wireless LAN as well as other types of communication may also be employed.

Such changes are regarded within a scope of the present invention.

What is claimed is:

1. A vehicular information provision apparatus comprising:

a stop detector configured to detect a temporal stop of a vehicle that is having a travel;

a display unit configured to display various information at a position that is viewable by occupants in the vehicle, the display unit being an in-vehicle display unit;

an information database configured to memorize information organized as long time information and short time information;

a control unit configured to control the display unit to display a plurality of display contents in a manner that (a) information contents elected from the database are processed to conclude within a stop time of the temporal stop, the stop time being pre-determined from a stop start time, and (b) two successive contents of information differ from each other while the vehicle is standing at the temporal stop detected by the stop detector; and a personal information accumulation device configured to accumulate personal information that at least includes a personal hobby and an idea of a driver of the vehicle, wherein extraction of the information contents is performed according to the personal information of the driver, and the extracted information contents are then elected from the information database and are processed for viewing by the driver.

2. The vehicular information provision apparatus of claim 1, wherein the control unit controls the display unit to display a content of information that is self-contained in one screen on the display unit as the short time information, and controls the display unit to display a content of information that is not self-contained in one screen as the long time information.

3. The vehicular information provision apparatus of claim 2, wherein the control unit controls the display unit to guide attention of the driver to the provided information away from a reason for the temporal stop.

4. The vehicular information provision apparatus of claim 1 further comprising:

a driver's condition detector configured to detect a current driver's condition; and a condition determiner configured to determine that the driver is in a usual condition according to the current driver's condition detected by the driver's condition detector based on a predetermined criterion, wherein, when the driver is determined to be in the usual condition, the control unit controls the display unit according to the driver's condition to display the content of information including a content of a predetermined time length.

5. The vehicular information provision apparatus of claim 4, wherein a current driver's operation detected as being diverted from a history of driver's operation stored in a database is used as one of predetermined criteria for determining that the driver's condition is not normal, and the determination of the driver's condition not being normal is used to control the display unit to avoid displaying information that includes the content of the predetermined time length.

6. The vehicular information provision apparatus of claim 5, wherein the information displayed on the display unit is configured to be edited in Consideration of driver's condition.

7. The vehicular information provision apparatus of claim 4, wherein a current driver's operation in association with driver's emotion that surfaces as voice tone, facial expression is detected as being diverted from a history stored in a database is used as one of predetermined criteria for determining that the driver's condition is not normal, and the determination of the driver's condition not being normal is used to control the display unit to avoid displaying information that includes the content of the predetermined time length.

8. The vehicular information provision apparatus of claim 7, wherein the information displayed finally on the display unit is the information that indicates that the vehicle is starting in a short time.

9. The vehicular information provision apparatus of claim 1, wherein the information displayed on the display unit shows a remaining time before the vehicle starts, and the brightness of the information on the display unit is configured to be dimmed as time elapses.

10. The vehicular information provision apparatus of claim 1, wherein the display contents are audio and/or visual entertainment acquired through an in- vehicle outside communications equipment.

11. The vehicular information provision apparatus of claim 1, further comprising a stop time calculation unit configured to calculate the stop time of the vehicle.

12. The vehicular information provision apparatus of claim 1, further comprising:

a communications unit configured to acquire traffic light information from a road-side infrastructure, wherein the stop time of the vehicle in the temporal stop is determined based on the traffic light information.

13. The vehicular information provision apparatus of claim 1, wherein a combination of short time information and long time information are elected from the information database, and the information contents elected from the information database are played back to the driver without interruption and have an end of playback which substantially coincides with the stop time of the temporal stop.

14. A vehicular information provision apparatus comprising:

a stop detector configured to detect a temporal stop of a vehicle that is having a travel;

a display unit configured to display various information at a position that is viewable by occupants in the vehicle, the display unit being an in-vehicle display unit;

an information database configured to memorize information organized as long time information and short time information;

a control unit configured to control the display unit to display a plurality of information contents in a manner that (a) information contents elected from the information database are processed to conclude within a stop time of the temporal stop, the stop time being pre- determined from a stop start time, and (b) two successive information contents differ from each other while the vehicle is standing at the temporal stop; and a personal information accumulation device configured to accumulate personal information that at least includes a personal hobby and an idea of a driver of the vehicle, wherein extraction of the information contents is performed according to the personal information of the driver, the extracted information contents are then elected from the information database and are processed for viewing by the driver, and the information content displayed finally on the display unit is information to prompt a driver of the vehicle to start the vehicle.

15. The vehicular information provision apparatus of claim 14, wherein two successive contents of information except for information displayed finally are serially displayed in a fade-out and fade-in manner between the two successive contents, and the information displayed finally on the display unit is abruptly displayed without fading- in for providing impression for the driver that the vehicle is about to start.

16. The vehicular information provision apparatus of claim 14, wherein the display contents are audio and/or visual entertainment acquired through an in-vehicle outside communications equipment.

17. The vehicular information provision apparatus of claim 14, wherein the control unit controls the display unit to display a content of information that is self-contained in one screen on the display unit as the short time information, and controls the display unit to display a content of information that is not self-contained in one screen as the long time information.

18. The vehicular information provision apparatus of claim 14, wherein a combination of short time information and long time information are elected from the information database, and the information contents elected from the information database are played back to the driver without interruption and have an end of playback which substantially coincides with the stop time of the temporal stop.

19. A vehicular information provision apparatus comprising:

a stop detector configured to detect a temporal stop of a vehicle that is having a travel;

a display unit configured to display various information at a position that is viewable by occupants in the vehicle, the display unit being an in-vehicle display unit;

an information database configured to memorize information organized as long time information and short time information;

a control unit configured to control the display unit to display a plurality of display contents in a manner that (a) information contents elected from the information database are processed to conclude within a stop time of the temporal stop, and (b) two successive contents of information differ from each other while the vehicle is standing at the temporal stop calculated by a stop detector a stop time calculation unit;

a driver's condition detector configured to detect a current driver's condition; and a condition determiner configured to determine that the driver is in a usual condition according to the current driver's condition detected by the driver's condition detector based on a predetermined criterion, wherein, when the driver is determined to be in the usual condition, the control unit controls the display unit according to the driver's condition to display the content of information including a content of a predetermined time length, wherein the control unit is configured to further determine the current driver's condition based on a number of occupants in the vehicle, wherein the control unit is configured to determine whether short time or long time information is to be displayed according to the current driver's condition.

20. The vehicular information provision apparatus of claim 19, wherein the control unit further determines whether the current driver's condition is affected by a condition of a co-occupant in the vehicle based on the number of occupants, includes a co-occupant condition in determining the current driver's condition and determines the current driver's condition to be different, when the current driver's condition is determined to be affected by the condition of the co-occupant based on the number of occupants, in comparison to the current driver's condition when the current driver's condition is not determined to be affected by the condition of the co-occupant based on the number of occupants.

* * * * *